US006520864B1

(12) United States Patent
Wilk

(10) Patent No.: US 6,520,864 B1
(45) Date of Patent: Feb. 18, 2003

(54) METHOD FOR TRACKING GOLF BALL

(76) Inventor: Peter J. Wilk, 185 W. End Ave., New York, NY (US) 10023

( * ) Notice: Subject to any disclaimer, the term of this patent is extended or adjusted under 35 U.S.C. 154(b) by 5 days.

(21) Appl. No.: 09/348,798

(22) Filed: Jul. 7, 1999

(51) Int. Cl.[7] ..... A63B 57/00
(52) U.S. Cl. ..... 473/152; 473/407
(58) Field of Search ..... 473/152, 156, 473/198, 199, 131, 150, 155, 169, 190, 407; 463/2; 434/252

(56) References Cited

U.S. PATENT DOCUMENTS 3,949,987 A * 4/1976 Candor ..... 434/252
4,666,157 A * 5/1987 Bodine et al. ..... 434/252
5,095,430 A * 3/1992 Bonito et al. ..... 473/150
5,413,345 A * 5/1995 Nauck ..... 273/185 R
5,489,099 A * 2/1996 Rankin et al. ..... 434/252
5,507,485 A * 4/1996 Fisher ..... 473/131
5,810,680 A * 9/1998 Lobb et al. ..... 473/407
5,873,797 A * 2/1999 Garn ..... 473/407
5,938,545 A * 8/1999 Cooper et al. ..... 473/407
6,012,987 A * 1/2000 Nation ..... 473/156
6,024,655 A * 2/2000 Coffee ..... 342/451
6,027,417 A * 2/2000 Zoretic et al. ..... 134/201
6,093,923 A * 7/2000 Vock et al. ..... 250/206.1
6,320,173 B1 * 11/2001 Vock et al. ..... 250/206.1
2002/0016210 A1 * 2/2002 Helber ..... 473/198

* cited by examiner

*Primary Examiner*—S. Thomas Hughes
*Assistant Examiner*—Steven Ashburn
(74) *Attorney, Agent, or Firm*—R. Neil Sudol; Henry Coleman; William Sapone

(57) ABSTRACT

In a method for assisting a golf player in tracking golf shots comprises, a video camera is operated at one point along a golf course fairway to generate a video signal encoding an image of a plurality of substantially stationary objects and of a target golf ball moving relative to the stationary objects. A computer is operated to process the video signal to detect the target golf ball, to automatically determine a path of motion of the target golf ball, and to modify at least a portion of the video signal to superimpose on a display of the stationary objects a curvilinear indication of the determined path of motion of the target golf ball. The camera is moved along the fairway toward the resting golf ball. The image displayed in modified to incorporate the changing view of the fairway, as well as a changed portion of the golf ball's path.

9 Claims, 2 Drawing Sheets

METHOD FOR TRACKING GOLF BALL

BACKGROUND OF THE INVENTION

This invention relates to the game of golf. More particularly, this invention relates to a method and an apparatus for assisting a golfer in tracking a golf ball which he or she has hit.

It is well known that a golfer must keep his or her head down when executing a golf stroke. If the head is moved upward prior to the completion-of the stroke, the golf club is likely to hit the ball at an undesired angle, thus causing the ball to hook or slice. Other misdirected strokes are also possible with an improper swing. For example, the ball might be "topped," which may result in a dribbling of the ball down the fairway.

Golf balls which have been sliced or hooked are frequently located in deep rough, tree groves or other hazards. Typically, these misdirected balls are very difficult to find. This difficulty, however, does not deter the golfer from his or her search. On the contrary, because of a two-stroke penalty imposed if a new ball has to be played, the golfer is especially motivated to find a misdirected ball. The search for a missing ball is pursued even though the golfer's companions, as well as other golfers on the course, are delayed in their pursuit of the game.

The hooking and slicing of golf balls is difficult to cure. Golfers prone to such strokes can be reinforced in their faulty swings by the very anxiety of losing the ball. Anticipating that he or she will slice or hook the ball, the golfer looks up prior to the termination of his or her swing, with the intention of visually tracking the ball. Thus, the fear of hooking or slicing causes the hooking or slicing.

OBJECTS OF THE INVENTION

An object of the present invention is to provide an apparatus and/or method which can improve a golfer's swing.

A more particular object of the present invention is to provide an apparatus and/or method which assists a golfer in tracking a hit golf ball.

Another object of the present invention is to provide such an apparatus and/or method which is easy to use.

A further object of the present invention is to provide such an apparatus and/or method which assist a golfer in keeping a record of his or her progress.

These and other objects of the present invention will be apparent from the drawings and description herein.

SUMMARY OF THE INVENTION

The present invention is generally directed to a camera and computer assisted device which automatically tracks a golfer's golf shots, thereby helping the golfer concentrate on his or her swing.

An apparatus for assisting a golf player in tracking golf shots comprises, in accordance with the present invention, a video camera generating a video signal encoding an image of a plurality of substantially stationary objects and of a target golf ball moving relative to the stationary objects. The apparatus further comprises a computer operatively connected to the camera for receiving the video signal therefrom. The computer includes generic digital processing circuits modified by programming (a) to process the video signal to detect the target golf ball, (b) to determine a path of motion of the target golf ball, and (c) to modify at least a portion of the video signal to superimpose on a view of the stationary objects a curvilinear indication of the determined path of motion of the target golf ball. The apparatus also includes a display operatively connected to the computer for receiving the modified portion of the video signal and displaying the view with the indication of the determined path of motion.

Generally, the computer encodes and stores the path of the golf ball so that the path may be displayed in overlay on an image of a fairway (or a driving range) after the ball has landed. As the golfer moves down the fairway to find his or her ball, the computer updates the displayed path to show successively shorter terminal portions of the ball's path.

In accordance with another feature of the present invention, the computer includes first additional generic processing circuits modified by programming to process the video signal to automatically estimate a distance of travel of the target golf ball and further includes second additional generic processing circuits modified by programming to generate a report as to the estimated distance of travel of the target golf ball. The report may be communicated visually to the user by providing a numerical figure on the display. Alternatively speech synthesis software and a speaker may be provided for an aural communication of the estimated distance of a golf shot. The estimate of distance may be accomplished on a driving range simply by having the computer automatically compare the final location of the ball with distance markers located on the driving range. On a golf course, the computer may require further input to make an accurate distance estimate. For example, the apparatus may be provided with a Doppler-type speed sensor and an angle or azimuth detector for enabling a calculation of distance from ball velocity and trajectory. Alternatively, the computer may be preprogrammed with distance data corresponding to visual markers such as trees and other hazards located along a fairway. A comparison executed by the computer pursuant to pattern recognition techniques identifies a hazard near which a hit ball has landed. A table is then consulted by the computer to determine the distance of the shot.

The computer optionally includes generic processing circuits modified by programming to classify the determined path of motion in one of a plurality of different classes of golf ball strokes or paths, to generate a statistical quantity incorporating the classification of the determined path of motion, and to store the statistical quantity. The statistical quantity may be simply the number of strokes of a certain type, such as hooks or slices. In addition, a percentage or proportion of the total strokes which are slices or hooks may be computed. This percentage can be calculated over several time periods of different durations, for example, over weeks, months and/or years. Thus, the computer compiles a record of the user's golf performance over time enabling the user to easily apprehend his or her progress at different times. Of course, the statistics compiled by the computer may include other numerical quantities, such as average estimated distances of travel, overall and according to the type of stroke, such as straight, slice, hook. The statistical quantities are all stored for subsequent communication to a user.

Pursuant to a further feature of the present invention, the computer includes additional generic processing circuits modified by programming to provide visually differentiable path indicators for different golf balls. For example, the additional generic processing circuits may indicate the paths of different balls in different colors on the display. If more than one of these shots are difficult to locate, the computer may be keyed to a particular point where the paths to the different balls diverge. Upon assisting in the locating of one ball, the apparatus is returned to the point of divergence to continue with tracking of another ball. The computer stores the different paths separately and is instructed to then track another ball. In that event, the computer is provided with a keyboard or other input to assist in selecting a ball path for tracking.

Pursuant to an additional feature of the present invention, the apparatus includes memory or signal store operatively connected to the computer for storing at least a portion of the video signal for later replay to a user. This feature is useful in the event that the user executes an especially memorable play. He or she may wish to review the shot at later date alone or with others. The computer may be provided with an output for downloading the video of the stored play to another computer of to a video tape machine.

The computer may be provided with additional generic processing circuits modified by programming to alter at least a portion of a subsequently received video signal from the camera to superimpose on a different view of the stationary objects a downstream or end segment of the curvilinear indication of the determined path of motion. In other words, the computer changes the displayed path to accord with the different view of the stationary objects as the stationary objects are approached and passed by the user during his or her negotiation of the fairway towards the green. This feature further assists a user to follow the path of a golf ball on the display even as the user approaches the ball at its location along a golf course fairway.

A method for assisting a golf player in tracking golf shots comprises, in accordance with the present invention, (a) operating a video camera to generate a video signal encoding an image of a plurality of substantially stationary objects and of a target golf ball moving relative to the stationary objects, (b) providing a display and a computer operatively connected to the display and to the camera for receiving the video signal from the camera, (c) operating the computer to process the video signal to detect the target golf ball, (d) further operating the computer to automatically determine a path of motion of the target golf ball, (e) additionally operating the computer to modify at least a portion of the video signal to superimpose on a view of the stationary objects a curvilinear indication of the determined path of motion of the target golf ball, and (f) also operating the computer to display on the display the view with the indication of the determined path of motion.

According to further aspect of the present invention, the computer is operated (g) to process the video signal to automatically estimate a distance of travel of the target golf ball and to generate a report as to the estimated distance of travel of the target golf ball and (h) to classify the determined path of motion in one of a plurality of different classes of golf ball strokes or paths, to generate a statistical quantity incorporating the classification of the determined path of motion, and to store the statistical quantity. The computer may be additionally operated to generate a statistical quantity incorporating the estimated distance of travel, and to store the statistical quantity for subsequent communication to a user.

An apparatus for monitoring motion of a ball comprises, in accordance with the present invention, a video camera and a computer operatively connected to the camera for receiving therefrom a video signal encoding an image of a plurality of relatively stationary objects and of a target object moving relative to the stationary objects, the computer being programmed (a) to analyze the video signal to detect the moving object, (b) to determine a path of motion of the moving object, (c) to modify at least a portion of the video signal to superimpose on at least a portion of the image a curvilinear indication of the determined path of motion of the moving object. A display is operatively connected to the computer for receiving the modified portion of the video signal and displaying the view with the indication of the determined path of motion.

The present invention is especially useful for individual golf players who do not customarily play golf with a caddy or other persons inclined to track golf shots. An apparatus and/or method in accordance with the present invention can improve a golfer's swing in particular by assisting the golfer in tracking a hit golf ball. Because the golfer need not worry about following the motion of his or her ball, he or she is facilitated in maintaining proper posture during the golf swing.

An apparatus and/or method in accordance with the present invention is easy to use. The main operation of the apparatus is automatic and thus user friendly.

An apparatus and/or method in accordance with the present invention assists a golfer in keeping a record of his or her progress.

DESCRIPTION OF THE PREFERRED EMBODIMENTS

Figure 1:
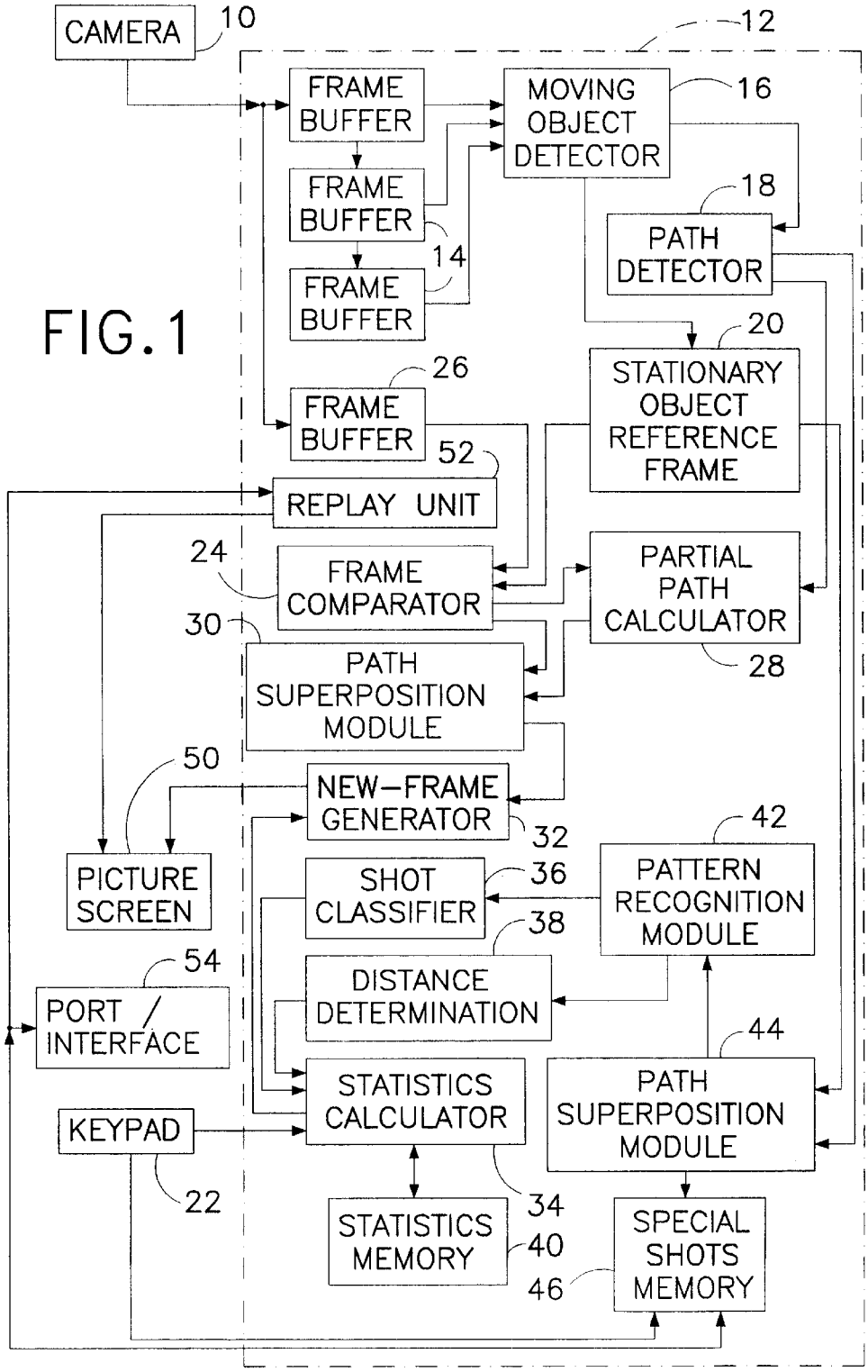
FIG. 1 is a block diagram of an apparatus for assisting a golfer in tracking his or her golf ball.
Figure 2:
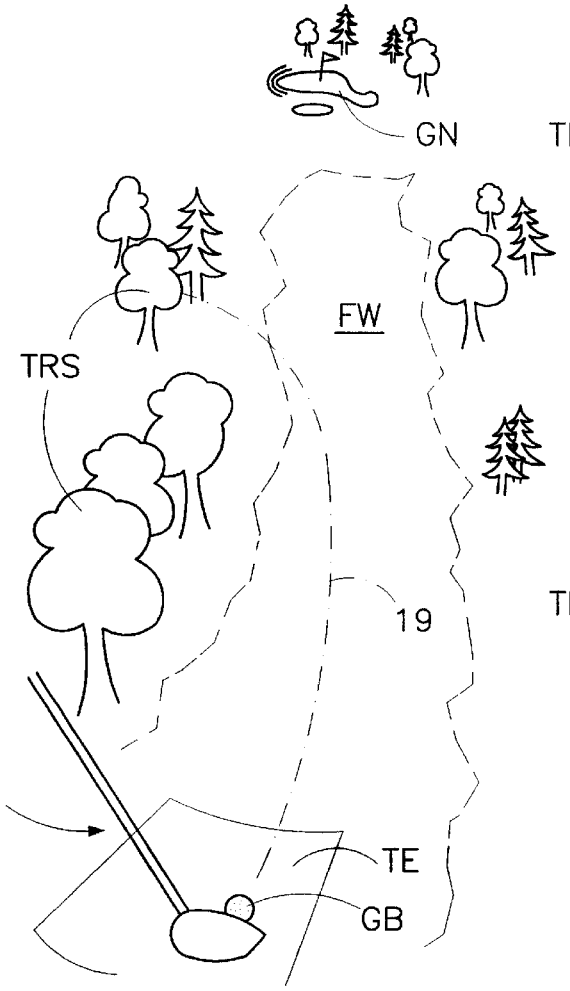
FIG. 2 is a diagram illustrated a generic golf fairway as viewed from the tee.

As illustrated in FIG. 1, an apparatus for assisting a golfer in tracking shots made by the golfer basically comprises a camera 10 and a computer 12 connected thereto. Camera 10 takes the form of a video camera which generates a video signal encoding an image of a plurality of substantially stationary objects, for example, trees TRS (FIG. 2), a golf fairway FW, a green GN and other hazards of a golf course particularly as viewed from a golf tee TE. Successive frames of the video image are temporarily stored in respective buffers 14 of computer 12. Buffers 14 arc connected in cascade to one another and at respective outputs to a module or circuit 16 of computer 12 for comparing the successive frames to detect a moving object such as a golf ball GB (FIG. 2). Detector module 16 may be provided with a dedicated internal memory for identifying one or more objects which are to be tracked by computer 12. This option eliminates the tracking of irrelevant objects such as birds and other fauna populating golf courses.

Computer 12 further includes a path detector 18 operatively connected at an input to detector module 16 for analyzing information from module 16 to determine, characterize, and temporarily store the curved path 19 of a golf ball struck by the user of the apparatus. Detector module 16 is also connected to an input of a memory or buffer 20 which temporarily stores a representative video frame or picture of fairway FW from tee TE. This representative frame or picture is stored until the next play by the user. A keypad 22 may be provided with a button (not separately illustrated for zeroing or resetting various modules or circuits of computer 12, including reference-frame memory or buffer 20.

The frame or picture stored by memory or buffer 20 serves as a reference for a updating operation performed by a comparator 24. Comparator 24 receives another video frame from a current frame buffer 26 connected to camera 10. The video frame from buffer 26 is a current or real-time view of the fairway captured by camera 10 as the user passes down fairway FW on the way to his or her ball. Comparator 24 compares the current view with the original or reference view from memory or buffer 20 and provides a cropping signal to a partial path calculator 28. Path calculator 28 receives the entire path 19 from detector 18 and, in response to the cropping signal from comparator 24, selects an end portion 29 of that path to match the current view from buffer 26. The current, partial view of fairway FW is transmitted from frame comparator 24 to a path superposition module 30 which also received the corresponding partial path 29 as selected by path calculator 28. Superposition module 30 generates a video frame of the current view from camera 10 with the appropriate end portion 29 of the path 19 of ball GB integrated into the image to overlie the images of the trees TRS and other stationary objects.

Figure 3:
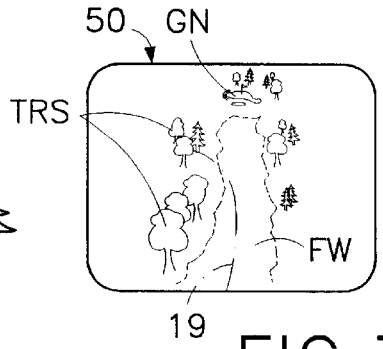
FIG. 3 is an elevational view of a video display or picture screen shown in FIG. 1, showing an image on the screen.
Figure 4:
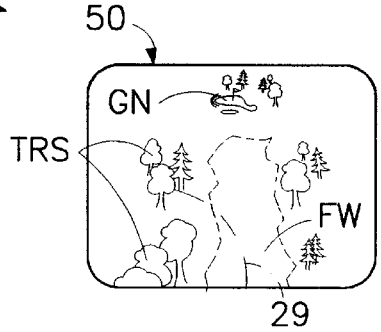
FIG. 4 is a view similar to FIG. 3, showing another image on the screen.
Figure 5:
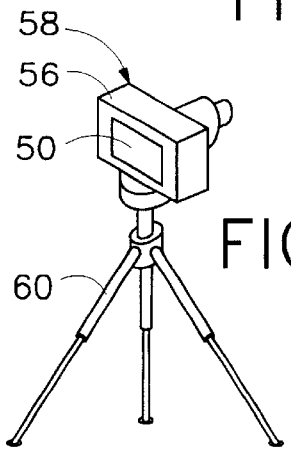
FIG. 5 is a schematic perspective view of a casing containing the camera and computer of FIG. 1.

The current image with the superimposed ball path 19 or the superimposed end portion 29 is viewed on a video display or picture screen 50. FIG. 3 illustrates the view from tee TE as displayed on picture screen 50, while FIG. 4 depicts a view from an intermediate position along fairway FW and shows only end portion 29 of path 19. Video display or picture screen 50 may be provided along a rear panel 56 of a casing 58 of camera 10 and computer 12, as illustrated in FIG. 5. Casing 58 is removably mounted to a tripod 60 which may be easily collapsed and inserted into a golf bag (not shown). Casing 58 may be carried by hand or even attached to a golf cart via an armature (not shown).

A video signal encoding the image of fairway FW with the ball path 19 or 29 is supplied to video display or picture screen 50 by a new-frame generator 32 connected to an output of superposition module 30. Further modifications to the image of the current view may be made by new-frame generator 32. Such modifications may include, for example, one or more statistical quantities characterizing the golf play of the user. Such quantities are transmitted from a statistics calculator 34. Calculator 34 receives input, for example, from a shot classifier 36 and a distance determination module 38. Shot classifier 36 determines whether a golf ball path 19 falls into any of several categories including slice, hook and straight path, while statistics calculator 34 consults a statistics memory 40 to determine such mathematical quantities as the proportion of shots made by the golfer within a certain time period are slices, hooks and straight shots. Distance determination module 38 provides estimates for the distances of at least some shots made by the golfer or user, while statistics calculator 34 consults memory 40 combines the determined distance with prior distances to yield a new average distance for the type of shot. Thus, statistics calculator 34 will maintain in memory 40 an average distance for slices, an average distance for hooks, and an average distance for straight shots. Other statistical quantities updated periodically or regularly by statistics calculator 34 is the percentage of total shots which are hooks, the percentage of total shots which are slices and the percentage of total shots which are straight shots.

Shot classifier 36 and distance determination module 38 are informed by a pattern recognition circuit or module 42 which in turn is provided with the reference frame from buffer 20 and the determined path 19 from path detector 18, as combined by a path superposition module 44. Pattern recognition module 42, for example, determines boundaries of a fairway and compares a golf ball path 19 with those boundaries. The comparison result is fed to shot classifier 36 which then decides whether the golf ball path 19 is a hook, a slice or a straight shot. Pattern recognition module 42 also reviews the representative frame or reference picture from buffer 20 to identify objects such as distance markers for enabling module 38 to make a distance determination.

Path superposition module 44 basically constructs an image of the original view from tee TB with the path 19 of ball GB superimposed in diagrammatic form (e.g., a colored line, a broken line, a series of arrows) on that view. This combined or edited view may be stored in a special memory 46 in response to an instruction from keypad 22. A user may wish to take advantage of this storage feature where a particular shot is unusually good, e.g., a hole in one. Alternatively , there may be a sufficient number of frame buffers 14 and adequate storage space in memory 46 so that an entire video sequence may be stored. In this case, a sequence of frames are loaded into memory 46 in response to an instruction from keypad 22. The user can playback the entire sequence as a video short memorializing a memorable golf shot.

In response to a further instruction from keypad 22, a digitalized still picture with a superimposed ball path may be delivered to picture screen or video display 50 from memory 46 via a replay unit 52. Alternatively, new-frame generator. 32 feeds a current frame, as modified with a superimposed ball path, to picture screen or video monitor 50. An override (not shown) connected to keypad 22 or replay unit 52 may be provided for temporarily blocking the video signal from new-frame generator 32 during a replay requested by the user.

Special shots memory 46 is also linked at an output to a port or interface 54 for purposes of enabling transfer of digitized image information from the memory to another device such as a desktop computer or a digital video recorder (neither shown).

As discussed above, camera 10 produces a video signal which is processed by computer 12 to detect golf ball GB, to determine ball path 19, and to modify at least a portion of the video signal to superimpose on a view of the stationary objects such as trees TRS a curvilinear indication of the determined path of motion 19 of golf ball GB. Generally, computer 12 encodes and stores golf ball path 19 so that the path may be displayed in overlay on an image of fairway FW after the ball has landed. As the golfer moves down fairway FW to find ball GB, computer 12 updates the displayed path to show successively shorter terminal portions 29 of the ball's path 19. Computer 12 is provided with functional digital processing modules 38, 42, and 44 to process the video signal to automatically estimate a distance of travel of golf ball GB and further digital processing modules 34 and 40 to generate a report as to the estimated distance of travel of golf ball GB. As discussed above, this report is communicated visually to the user by providing a numerical figure on video display or picture screen 50. Alternatively, speech synthesis software and a speaker (not shown) may be provided for an aural communication of the estimated distance of a golf shot. The estimate of distance is accomplished on a driving range simply by having computer 12 operate pursuant to pattern recognition software to automatically compare the final location of ball GB with distance markers located on the driving range. On a golf course, computer 12 may estimate distance pursuant to markers such as particular trees TRS, the distances of these markers and their identities being preloaded into computer 12 for the different holes of a course. A comparison executed by computer 12 pursuant to pattern recognition techniques identifies a hazard near which a hit ball has landed. A table is then consulted by computer 12 to determine the distance of the shot. Alternatively, computer 12 may be connected to a Doppler-type speed sensor (not shown) and an angle or azimuth detector (not shown) for enabling a calculation of distance from ball velocity and trajectory.

Figure 6:
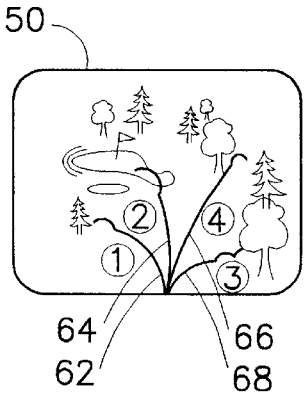
FIG. 6 is a view similar to FIGS. 3 and 4, showing a different image on the screen.

As indicated in FIG. 6, computer 12 is capable of providing visually differentiable indications of paths 62, 64, 66, 68 for different golf balls of the members of a group of golfers. For example, paths 62, 64, 66, 68 may be displayed in different colors on video display or picture screen 50. Alternatively, the displayed paths 62, 64, 66, 68 may have different line types, such as solid, dashed, dotted, and dot-dashed. If more than one of these shots are difficult to locate, computer 12 may be keyed to a particular point where the paths to the different balls diverge. Upon assisting in the locating of one ball, the apparatus is returned to the point of divergence to continue with tracking of another ball. The computer stores the different paths 62, 64,66, 68 separately and is instructed to then track another ball. Keypad 22 is used by the golfers to instruct computer 12 in selecting a ball path for tracking.

Computer 12 is generally contemplated to be a specially programmed microprocessor having generic digital processing circuits modified by programming to form the various modules and circuits discussed above with reference to FIG. 1.

The present invention may be utilized on a golf driving range, as well as on a golf course. The apparatus of FIG. 1 can track successive practice shots, show the paths of one or more golf balls on screen or display 50.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof

What is claimed is:

1. A method for assisting a golf player in tracking golf shots, comprising:

operating a video camera at an initial location along a golf course fairway to generate a first video signal encoding a first image of a plurality of substantially stationary objects along said fairway and of a target golf ball moving relative to said stationary objects;

providing a computer and a display, said computer being operatively connected to said camera for receiving said video signal therefrom, said computer being connected to said display;

operating said computer to process said video signal to detect said target golf ball;

further operating said computer to automatically determine a path of motion of said target golf ball and an end point of said path of motion;

additionally operating said computer to modify at least a portion of said video signal to superimpose on a view of said stationary objects a curvilinear indication of the determined path of motion of said target golf ball;

also operating said computer to display on said display said view with said indication of said determined path of motion;

after the display of said view with said indication of said determined path of motion, moving said video camera along said fairway from said initial location toward said end point;

between said initial location and said end point, operating said video camera to generate a second video signal encoding a second image of only some of said substantially stationary objects along said fairway;

supplementally operating said computer to modify at least a portion of said second video signal from said camera to superimpose on said second image a downstream or end segment of said curvilinear indication of said determined path of motion, thereby enabling a user to visualize said path of motion on said display as the user approaches the target golf ball at its location along said fairway.

2. The method defined in claim 1, further comprising operating said computer to process said first video signal to automatically estimate a distance of travel of said target golf ball and to generate a report as to the estimated distance of travel of said target golf ball.

3. The method defined in claim 2, further comprising operating said computer to classify said determined path of motion in one of a plurality of different classes of golf ball strokes or paths, to generate a statistical quantity incorporating the classification of said determined path of motion, and to store said statistical quantity.

4. The method defined in claim 2, further comprising operating said computer to generate a statistical quantity incorporating said estimated distance of travel, and to store said statistical quantity for subsequent communication to a user.

5. The method defined in claim 1, further comprising operating said computer to provide visually differentiable path indicators for different golf balls.

6. The method defined in claim 5, further comprising operating said computer to generate said visually differentiable path indicators in different colors on said display.

7. The method defined in claim 1, further comprising storing at least a portion of said first video signal for later replay to a user.

8. The method defined in claim 1, further comprising operating said computer to classify said determined path of motion in one of a plurality of different classes of golf ball strokes or paths, to generate a statistical quantity incorporating the classification of said determined path of motion, and to store said statistical quantity.

9. The method defined in claim 1, further comprising operating said computer to generate at least one statistical quantity pertaining to a player's golf stroke and to store said statistical quantity for subsequent communication to said player.

* * * * *